US006025767A

United States Patent [19]

Kellam et al.

[11] Patent Number: 6,025,767

[45] Date of Patent: Feb. 15, 2000

[54] ENCAPSULATED MICRO-RELAY MODULES AND METHODS OF FABRICATING SAME

[75] Inventors: Mark D. Kellam, Chapel Hill; Michele J. Berry, Carrboro, both of N.C.

[73] Assignee: MCNC, Research Triangle, N.C.

[21] Appl. No.: 08/692,502

[22] Filed: Aug. 5, 1996

[51] Int. Cl.[7] ..... H01H 67/02

[52] U.S. Cl. ..... 335/128; 257/415

[58] Field of Search ..... 335/78–86, 128; 257/415; 200/183, 283, 83 N; 307/132 E, 143; 437/921, 739

[56] References Cited

U.S. PATENT DOCUMENTS

| | | | |
|---|---|---|---|
| 557,132 | 9/1896 | Takashi | 335/78 |
| 3,244,947 | 4/1966 | Slater . | |
| 3,259,814 | 7/1966 | Green . | |
| 3,274,458 | 9/1966 | Boyer et al. . | |
| 3,316,465 | 4/1967 | von Bernuth et al. . | |
| 3,489,965 | 1/1970 | Helsdon . | |
| 3,916,080 | 10/1975 | Wakamatsu . | |
| 3,959,577 | 5/1976 | Frink . | |
| 3,993,123 | 11/1976 | Chu et al. . | |
| 4,168,480 | 9/1979 | DeLucia | 335/151 |
| 4,257,905 | 3/1981 | Christophorou et al. | 252/571 |
| 4,449,580 | 5/1984 | Reisman et al. . | |
| 4,511,873 | 4/1985 | Baier et al. . | |
| 4,563,697 | 1/1986 | Miura . | |
| 4,565,901 | 1/1986 | Hirooka et al. . | |
| 4,897,508 | 1/1990 | Mahulikar et al. . | |
| 5,046,161 | 9/1991 | Takada . | |
| 5,325,265 | 6/1994 | Turlik et al. . | |
| 5,475,280 | 12/1995 | Jones et al. | 313/309 |
| 5,627,396 | 5/1997 | James et al. | 257/415 |

FOREIGN PATENT DOCUMENTS

| | | |
|---|---|---|
| 42 05 029 | 2/1993 | Germany . |
| 43 23 799 | 1/1994 | Germany . |

OTHER PUBLICATIONS

Guckel et al., *Electromagnetic Linear Actuators with Inductive Position Sensing for Micro Relay, Micro Valve and Precision Positioning Applications*, Transducer '95, Eurosensors IX, The 8th International Conference on Solid–State Sensors and Actuators, and Eurosensors IX, pp. 324–327.

Hashimoto et al., *Thermally Controlled Magnetization Microrelay*, Transducers '95, Eurosensors IX, The 8th International Conference on Solid–State Sensors and Actuators, and Eurosensors IX, pp. 361–364.

Drake et al., *An Electrostatically Actuated Micro–Relay*, Transducers '95, Eurosensors IX, The 8th International Conference on Solid–State Sensors and Actuators, and Eurosensors IX, pp. 380–383.

Knüppel, *Rugged Design for Reliable Switching: Micro A Relay Sets New Automotive Standards*, Components XXIX (1994), No. 4, pp. 30–32.

Hosaka et al., *Electromagnetic Microrelays: Concepts and Fundamental Characteristics*, Sensors and Actuators A, 40 (1994), pp. 41–47.

Specification Sheet, *NAiS, Ultra Low Profile 2 Amp–PolArized Relay*, TK–Relays.

*Primary Examiner*—Lincoln Donovan
*Attorney, Agent, or Firm*—Alston & Bird LLP

[57] ABSTRACT

A micro-relay module includes a substrate and a lid in spaced apart relation, and a solder ring which bonds the lid to the substrate to define a chamber therebetween. A micromachined relay is integrally formed on the substrate or on the lid within the chamber. A gas is contained in the chamber at a gas pressure which is above atmospheric pressure. Input/output pads are included outside the chamber and electrically connected to the micromachined relay. Large numbers of encapsulated modules may be fabricated on a single substrate by integrally forming an array of relays on a face of a first substrate. A second substrate is placed adjacent the face with a corresponding array of solder rings therebetween, such that a respective solder ring surrounds a respective relay. The solder rings are reflowed in a gas atmosphere which is above atmospheric pressure to thereby form an array of high pressure gas encapsulating chambers. The first and second substrates are then singulated for form a plurality of individual micro-relay modules.

44 Claims, 3 Drawing Sheets

ENCAPSULATED MICRO-RELAY MODULES AND METHODS OF FABRICATING SAME

FIELD OF THE INVENTION

This invention relates to microelectronic devices and modules and more particularly to microelectronic relay devices and modules, and methods of fabricating same.

BACKGROUND OF THE INVENTION

Relays are widely used as switching devices. For example, the telecommunications industry uses relays for many switching applications, at a current market value of approximately $500 million per year. Mechanical relays are highly developed commodity products. An example of a conventional mechanical relay is the NAIS TK Ultralow Profile 2 Amp Polarized Relay. Relays are often encapsulated with a high pressure gas. See U.S. Pat. No. 4,168,480 to De Lucia.

Microelectromechanical systems (MEMS) have recently been developed as alternatives for conventional electromechanical devices such as relays. MEMS devices are potentially low cost devices, due to the use of microelectronic fabrication techniques. New functionality may also be provided because MEMS devices can be much smaller than conventional electromechanical devices. A MEMS relay, also referred to herein as a micro-relay or a micromachined relay are described in publications entitled *"An Electrostatically Actuated Micro-Relay"* by Drake et al., The 8th International Conference on Solid-State Sensors and Actuators, and Eurosensors IX, Stockholm, Sweden, Jun. 25–29, 1995, pp. 380–383; *"Thermally Controlled Magnetization Microrelay"* to Hashimoto et al., The 8th International Conference on Solid-State Sensors and Actuators, and Eurosensors IX, Stockholm, Sweden, Jun. 25–29, 1995, pp. 361–364; *"Electromagnetic Linear Actuators With Inductive Position Sensing for Micro Relay, Micro Valve and Precision Positioning Applications"* by Guckel et al., The 8th International Conference on Solid-State Sensors and Actuators, and Eurosensors IX, Stockholm, Sweden, Jun. 25–29, 1995, pp. 324–327; *"Electromagnetic Microrelays: Concepts and Fundamental Characteristics"* by Hosaka et al., Sensors and Actuators A, Vol. 40, 1994, pp. 41–514 47; and *"Rugged Design for Reliable Switching: Micro A Relay Sets New Automotive Standards"* by Knuppel, Siemens Components (English Edition), Vol. 29, No. 4, July–August 1994, pp. 30–32, the disclosures of which are hereby incorporated herein by reference.

Micro-relays have heretofore made few inroads in the conventional mechanical relay market. The primary reasons for lack of market penetration appear to be cost and performance. As to cost, even though conventional relays may require coil winding and assembly operations, the mature market and off-shore assembly of conventional mechanical relays has maintained a low cost. As to performance, telecommunications relays typically must provide a high breakdown voltage of about 2000 volts or more, so as to withstand a direct lightning strike. A long lifetime and vibration resistance must also generally be provided. In view of the higher cost and lower performance of micro-relays, their market penetration presently continues to be small.

SUMMARY OF THE INVENTION

It is therefore an object of the present invention to provide improved micro-relays and methods of fabricating same.

It is another object of the present invention to provide low cost micro-relays and methods of fabricating same.

It is another object of the invention to provide high performance micro-relays and methods of fabricating same.

These and other objects are provided, according to the present invention, by a micro-relay module which includes a substrate and a lid in spaced apart relation, and a solder ring which bonds the lid to the substrate to define a chamber therebetween. A micromachined relay is integrally formed on the substrate or on the lid, within the chamber. A gas is contained in the chamber at a gas pressure which is above atmospheric pressure. The gas contacts the micromachined relay. A plurality of input/output pads are included outside the chamber, and electrically connected to the micromachined relay.

According to the invention, a bonded solder ring may be used to enclose high pressure gas at pressures of up to 20 atmospheres or more in the chamber. Because the chamber is small, the structure can contain the high pressure gas. The high pressure gas greatly increases the breakdown voltage of the relay, to about 5000 volts or more. Moreover, the high pressure gas may also reduce sputter degradation which is a major failure mechanism of relays. The inherent reliability of a micromachined relay provides excellent vibration resistance and an extended lifetime. Accordingly, high performance micro-relay modules may be provided.

In one embodiment of the present invention, a micromachined relay is integrally formed on a face of the substrate within the chamber, and the input/output pads are formed on the substrate face outside the chamber. The substrate includes means for electrically connecting the micromachined relay to the input/output pads, using surface or buried wiring. Alternatively, the micromachined relay may be integrally formed on a face of the lid within the chamber and the micro-relay modules includes means, within the chamber, for electrically connecting the micromachined relay to the substrate. In a preferred embodiment, solder bumps within the chamber, extending between the substrate and the lid, may be used to electrically connect the micromachined relay on the lid to the substrate.

The lid and substrate may both include solder wettable bonding sites thereon so that the solder ring is bonded to the wettable bonding sites. Preferably, the wettable bonding sites and/or the solder ring are pretreated with a fluorine-containing plasma so that soldering may be performed without the use of the flux. The cavity is thereby rendered free of any residual flux which could degrade the performance and lifetime of the micro-relay. The micromachined relay may be fabricated using conventional MEMS manufacturing techniques.

Active microelectronic circuits may also be included in the micro-relay module. Preferably, if the micromachined relay is integrally formed on one of the substrate and the lid, the active microelectronic circuits are integrally formed on the other of the substrate and the lid, so that MEMS devices and conventional microelectronic circuits may be formed on different substrates.

It will be understood that the substrate, lid, solder ring, high pressure gas and input/output pads may be used to form a MEMS module including MEMS devices other than relays. Such a MEMS module may also be expected to have high breakdown characteristics and thereby overcome breakdown problems of many conventional MEMS devices.

Large numbers of encapsulated MEMS modules maybe fabricated on a single substrate according to the present invention, to thereby reduce manufacturing cost and make MEMS modules competitive with conventional electromechanical modules. In particular, a MEMS module is formed by integrally forming an array of MEMS devices on a face of a first substrate. A second substrate is placed adjacent the face with a corresponding array of solder rings therebetween, such that a respective solder ring surrounds a respective MEMS device. The solder rings are reflowed in a gas atmosphere which is above atmospheric pressure to thereby form an array of high pressure gas encapsulating chambers for the array of MEMS devices. The first and second substrates are then singulated to form a plurality of individual MEMS modules. Low cost, high performance MEMS modules are thereby fabricated.

The solder bonding step may take place by bonding the array of solder rings to the second substrate and placing the second substrate adjacent the face of the first substrate with the bonded array of solder rings therebetween. Alternatively, the solder rings may be bonded to the face of the first substrate, and the second substrate may be placed adjacent the face with the bonded array of solder rings therebetween. In yet another alternative, solder ring preforms may be placed between the first and second substrates, and then simultaneously bonded to both faces. The reflowing step is preferably preceded by the step of performing a fluxless plasma pretreatment on the solder rings, so that the reflow takes place without flux. Accordingly, high performance is maintained.

DETAILED DESCRIPTION OF PREFERRED EMBODIMENTS

Figure 1:
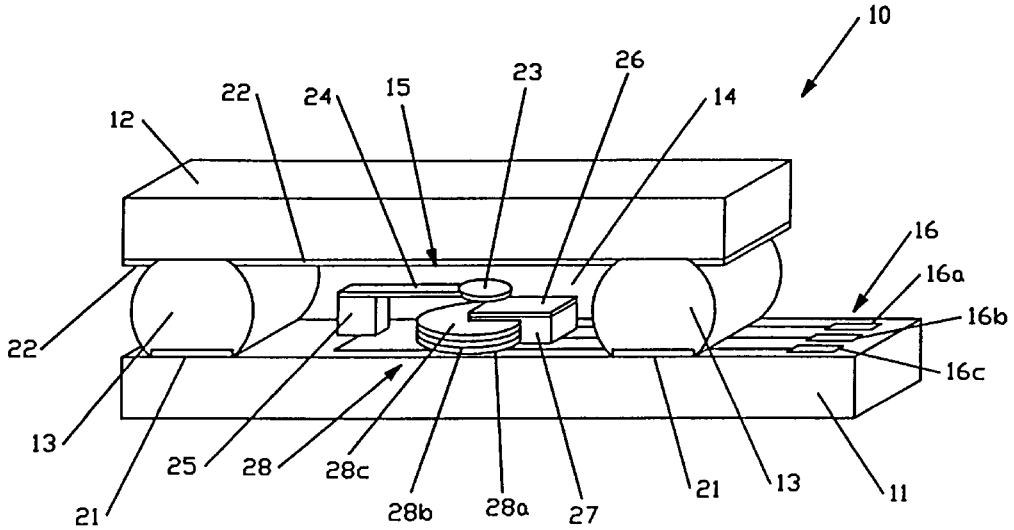
FIG. 1 is a perspective view of a first embodiment of a micro-relay module according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout.

FIG. 1 is a perspective view of a first embodiment of a micro-relay module according to the present invention. As shown in FIG. 1, micro-relay module 10 generally includes a substrate 11 and a lid 12 in spaced apart relation. A solder ring 13 bonds the lid to the substrate to define a chamber 14 therebetween. A micromachined relay 15 is integrally formed on the substrate 11 within chamber 14. A plurality of relays may also be formed within chamber 14, or one or more relays and others MEMS devices may be formed within chamber 14. Gas is contained in chamber 14, at a gas pressure which is above atmospheric pressure. The gas contacts the micromachined relay. Finally, a plurality of input/output pads 16 on the substrate 11 outside chamber 14 are electrically connected to the micromachined relay 15. The electrical connectors may include an insulating layer thereon, to prevent the solder ring 13 from shorting the connectors to one another.

Details of the micro-relay module 10 will now be described. Substrate 11 may be a monocrystalline silicon substrate, a glass substrate or any other substrate which is conventionally used for microelectronic or MEMS applications. As shown in FIG. 1, substrate 11 includes a bonding region 21 in the form of metallization or other conventional solder wettable material, for bonding to solder ring 13. Alternatively, in order to define a bonding region, solder dams 22 may be used as shown on lid 12 if the lid is a solder wettable material. The fabrication of solder bonding regions and solder dams to confine solder on a substrate is well known to those having skill in the art and need not be described further herein.

Solder ring 13 bonds lid 12 to substrate 11. The solder ring 13 may be circular, rectangular, square, polygonal or of any other shape. Conventional lead-tin solder may be used. Other solder formulations may also be used. In other applications, the bonding may take place using brazing, gluing or other known bonding techniques. Preferably, the bonding is sufficiently strong so as to contain a gas in the chamber 14 formed thereby, at greater than atmospheric pressure, preferably in the range from 10 to 20 atmospheres, to thereby increase the breakdown voltage of relay 15, which is enclosed within chamber 14.

Relay 15 may be formed by conventional MEMS techniques which need not be described in detail herein. In general, relay 15 includes a pole piece 23, a first relay contact comprising conductive cantilever (bending beam) 24 and first support 25, and a second relay contact 26 on second support 27. The relay magnet 28 may include a field concentrator 28*a*, an insulator 28*b* and a coil 28*c*. Also contained on substrate 11 are input/output pads 16. Three contact pads 16*a*, 16*b* and 16*c* are shown. However, it will be understood that more or fewer pads may be provided. As shown in FIG. 1, third input/output pad 16*c* is electrically connected to first relay contact 24. Second input/output pad 16*b* is electrically connected to second relay contact 26, and first input/output pad 16*a* is electrically connected to a relay magnet 28. The electrical connectors may include an insulating layer thereon, to prevent the solder ring 13 from shorting the connectors to one another.

Figure 4:
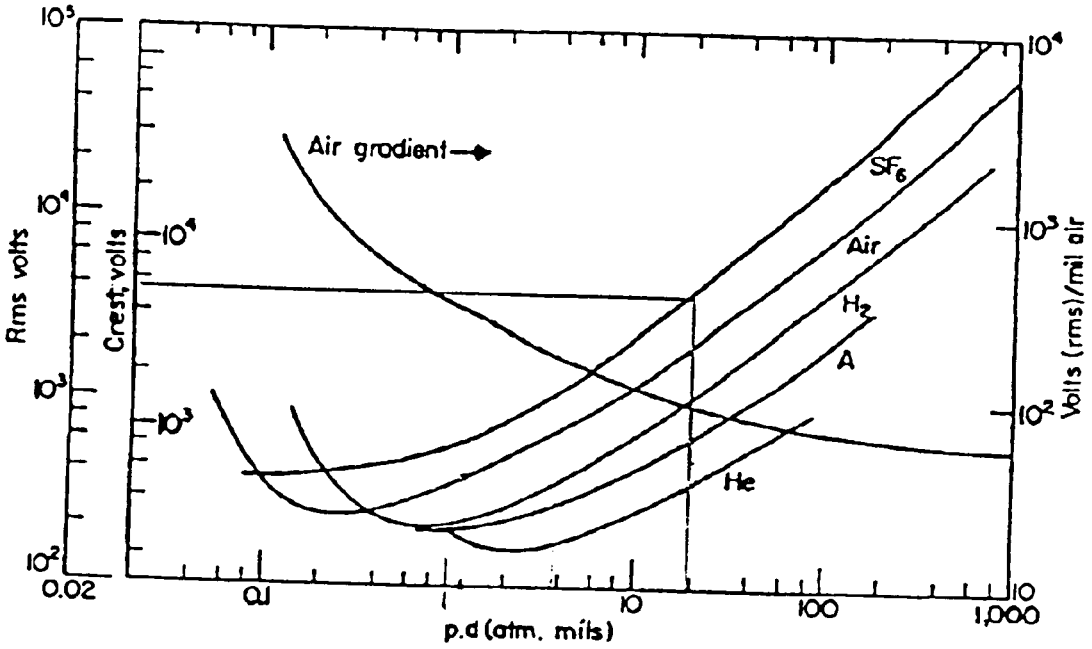
FIG. 4 illustrates Paschen curves for breakdown voltages as a function of pressure for various gases.

The relay materials and dimensions, and the high pressure gas in chamber 14 may be selected to prevent electrical breakdown between the relay contacts 24 and 26 of up to 5000 volts or more. For example, a 25 $\mu$m gap between pole piece 23 and second relay contact 26 may withstand more than 5000 volts in 20 atmospheres of $SF_6$ as illustrated by the Paschen curves which are reproduced in FIG. 4. Other gases such as nitrogen may be used. However, they may only be able to withstand lower voltages.

Figure 2:
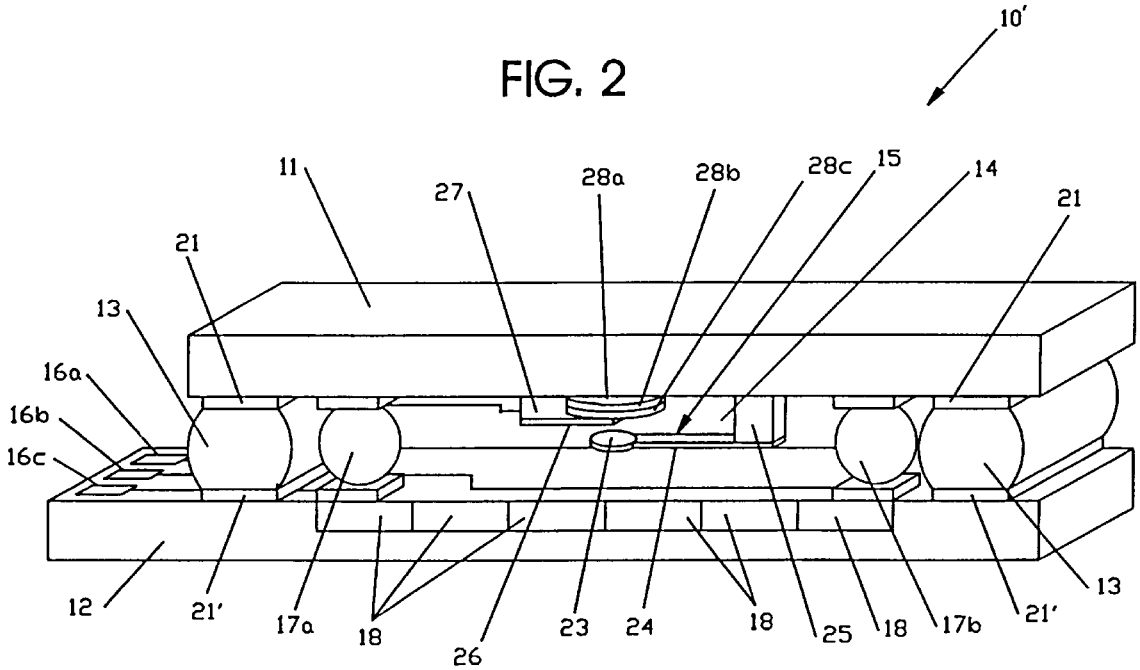
FIG. 2 is a perspective view of a second embodiment of a micro-relay module according to the present invention.

FIG. 2 illustrates an alternate embodiment 10' of micro-relay module 10. In contrast with FIG. 1, relay 15 is formed on lid 12. In order to electrically connect relay 15 with input/output pads 16 on substrate 11, solder bumps, two of which are shown in FIG. 2, may be used. For example, solder bump 17*a* electrically connects the second relay contact 26 with pad 16*a*. Solder bump 17*b* electrically connects the first relay contact 24 with the second pad 16*b*. A third solder bump may be required to contact the relay magnet 28 with the third solder I/O pad 16*c*. It will be understood that other connecting means can be used instead of solder bumps. However, solder bumps are particularly amenable to formation at the same time that solder ring 13 is bonded.

As also illustrated in FIG. 2, substrate 11 includes active microelectronic circuits 18 therein. These microelectronic circuits may include microprocessors, controllers, memory devices, drivers and other conventional microelectronic circuits. Due to the generally differing processing requirements of microelectronic circuits 18 and micromachined relay 15, it may be preferable that they be formed on different substrates. Accordingly, in FIG. 2, microelectronic circuits 18 are formed in substrate 11 and micromachined relay 15 is formed on lid 12. However, these devices may also be formed on the same substrate. Finally, in the embodiment of FIG. 2, bonding regions 21 and 21' are in the form of wettable rings. Solder dams need not be used. It will also be understood that one or both of the bonding regions may be unpatterned, i.e. the entire substrate may be covered with, or formed of, solder wettable material.

Figure 3A:
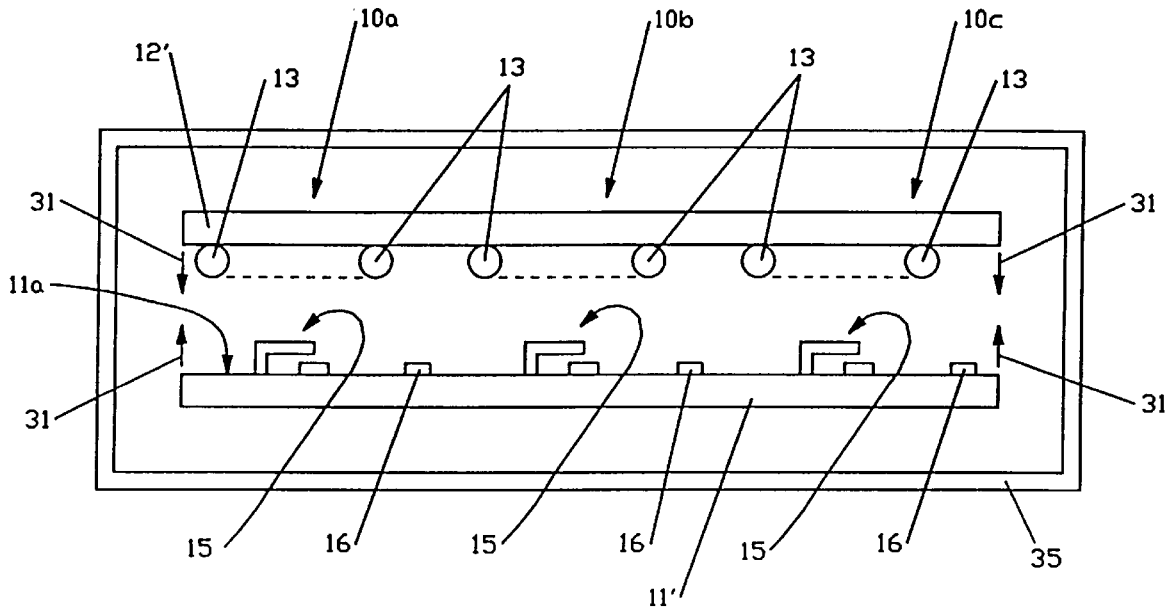
FIG. 3A is a cross-sectional view of a micro-relay module of FIG. 1 during a first intermediate fabrication step.
Figure 3B:
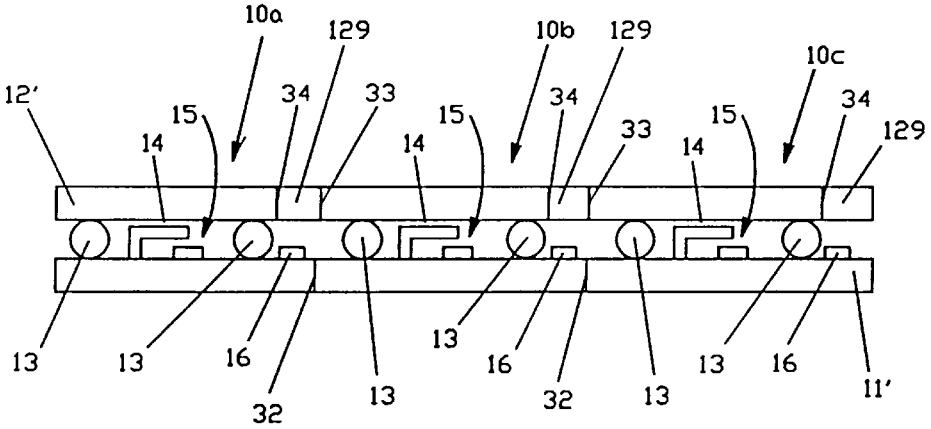
FIG. 3B is a cross-sectional view of a micro-relay module of FIG. 1 during a second intermediate fabrication step.

Referring now to FIGS. 3A and 3B, a method of fabricating a plurality of micro-relay modules 10 of FIG. 1 will now be described. It will be understood by those having skill in the art that methods according to the present invention may also be used to fabricate a plurality of MEMS modules which includes MEMS devices other than relays, such as motors, actuators and the like. For ease of explanation, FIGS. 3A and 3B illustrate the parts of FIG. 1 in schematic form, and eliminate many details of relay 15.

FIGS. 3A and 3B illustrate only three modules 10*a*, 10*b* and 10*c* which are formed simultaneously. However, it will be understood by those having skill in the art that typically many more modules are formed simultaneously. For example, on 4" wafers, up to 4,000 or more modules may be formed simultaneously in an array.

Referring now to FIG. 3A, an array of MEMS devices 10*a*–10*c* are formed on a face of a first substrate 11'. An array of input/output pads 16 is also formed on face 11*a* of substrate 11'.

The fabrication of MEMS devices are well known to those having skill in the art and need not be described in detail herein. However, the fabrication of a MEMS relay 15 as illustrated in detail in FIG. 1, will be briefly described. Face 11*a* of substrate 11' may first be patterned to form the lines which connect the relay parts to the input/output pads 16. A photopatterning sequence may be performed on an oxidized silicon wafer to produce a liftoff mask with reentrant sidewall profiles. A metal stack may then be additively deposited using evaporation. The metal stack may be a Ti/Al/Pd stack to provide adequate adhesion to the substrate, high current capacity and a seed layer for plating and wire bonding capabilities.

The next element of the micro-relay to be fabricated is the relay electromagnet 28. The field concentrator 28*a* is located beneath the coil 28*c* and is formed of a magnetic material such as Ni or permalloy. Insulator 28*b* may be formed of silicon nitride or other insulating materials using plasma enhanced chemical vapor deposition. Vias may be etched in this material to provide contact with the underlying metal pattern. A planar coil 28*c*, formed for example of Cu, may then be deposited using standard liftoff processes. This metal deposition step may also be used to form the bonding region 21 for the solder ring 13. A thick dielectric layer may then be deposited and appropriately etched to form first support 25. A via may be etched through the first support and filled, so that electrical contact may be made. Plating may be used to fill the via. Metal may then be deposited on the dielectric to form the first and second relay contacts 24 and 26 respectively.

Once the bottom of the relay is formed, a gap between the contacts is formed. The gap may be formed by coating a very thick polymer layer such as photoresist. The conductive cantilever 25 may be patterned and formed on the thick polymer layer using Ni plating. An Au/Ti/Ni/Ti/Au structure may be formed. Other metallurgies may be used. Then, the polymer layer may be removed using a release process to form a freestanding cantilever. Other well known MEMS processes may be used to form relays or other MEMS devices, as is well known to those having skill in the art.

Still referring to FIG. 3A, second substrate 12' is fabricated separately. Underbump metallurgy may be deposited in a blanket layer to serve as a current path for electroplating the solder rings 13. The top surface of the underbump metallurgy may be a nonwettable metal that is patterned in the shape and size of the base of the seal for the solder ring. A photoresist template may then be patterned to provide a large volume region for the ring to be plated with solder. The solder may then be reflowed and the field metal etched. It will be understood by those having skill in the art that other embodiments may initially form the solder rings on substrate 11' rather than substrate 12' as illustrated. In yet other embodiments, solder preforms may be formed and inserted between substrates 12' and 11' prior to reflow. It will also be understood that a plurality of individual substrates, with or without solder rings, may be picked and placed in spaced apart relation to a large substrate, and reflowed.

In a preferred embodiment of the present invention, the first and second substrates 11' and 12' including the MEMS device 15 and the solder rings therebetween are then placed adjacent one another in the direction shown by arrows 31 as illustrated in FIG. 3B. A high pressure reflow is then performed to encapsulate $SF_6$, $N_2$ or other gases in the chambers. Reflow may take place at 250° C. for eutectic lead—tin solder, for example, but high lead content solder may be preferred for compatibility with subsequent assembly processes.

In the preferred embodiment of the present invention, a fluxless solder treatment is performed prior to or simultaneous with, reflow. Fluxless solder treatment insures that flux is not used in the process and will not remain in chambers 14. It will be understood that residual flux in chambers 14 could have a deleterious effect on the operation and reliability of the micro-relay module 10.

A preferred fluxless soldering process exposes the solder rings 13 and/or pads 21 or 21' to a fluorine-containing plasma and reflows the solder as described in detail in U.S. Pat. No. 4,921,157 entitled "A Fluxless Soldering Process" to Dishon et al. and assigned to the assignee of the present invention, the disclosure of which is hereby incorporated herein by reference. Fluorine plasma pretreatment may be accomplished in an apparatus described in U.S. Pat. No. 5,499,754 entitled "Fluxless Soldering Sample Pretreating System" to Koopman et al. and assigned to the assignee of the present invention, the disclosure of which is hereby incorporated herein by reference. Reflow may then take place in a system 35 that can accommodate a high pressure gas such as $SF_6$.

Finally, referring to FIG. 3B, the first substrate 11' and the second substrate 12' are singulated to thereby produce the individual micro-relay modules. As shown in FIG. 3B, first cuts 32 are made in substrate 11' and second cuts 33 are made in substrate 12' in order to form substrate 11 and lid 12 (FIG. 1) respectively. It will be understood that the first and second cuts may be made simultaneously using laser cutting, saws, dicing or any other known technique. In order to expose input/output pads 16, a third cut is made in substrate 12' to remove portions 12*a* of substrate 12'. The micro-relay module 10 may then be wire bonded and encapsulated in a conventional plastic package or other package. The micro-relay module can provide plug compatible replacements for existing relays.

Micro-relay modules fabricated as described above may provide improved performance at reduced cost. In particular, a high breakdown voltage and high operating lifetime may be provided at a cost which may be a fraction of a conventional mechanical relay.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A micro relay module comprising:

a substrate and a lid in spaced apart relation;

a solder ring which bonds said lid to said substrate to define a chamber therebetween;

a micromachined relay integrally formed on one of said substrate and said lid, within said chamber;

gas in said chamber, at a gas pressure which is above atmospheric pressure, and contacting said micromachined relay; and a plurality of input/output pads outside said chamber, and electrically connected to said micromachined relay.

2. A micro relay module according to claim 1 wherein said micromachined relay is integrally formed on a face of said substrate within said chamber, and wherein said plurality of input/output pads are formed on said substrate face, outside said chamber.

3. A micro relay module according to claim 2 wherein said substrate further comprises means for electrically connecting said micromachined relay to said input/output pads.

4. A micro relay module according to claim 1 wherein said micromachined relay is integrally formed on a face of said lid within said chamber, and wherein said micro relay module further comprises means, within said chamber, for electrically connecting said micromachined relay to said substrate.

5. A micro relay module according to claim 4 wherein said electrically connecting means comprises a plurality of solder bumps within said chamber, extending between said substrate and said lid.

6. A micro relay module according to claim 1 wherein each of said substrate and said lid include a solder wettable bonding site thereon, and wherein said solder ring bonds said solder wettable bonding sites to one another.

7. A micro relay module according to claim 1 wherein said chamber is free of solder flux therein.

8. A micro relay module according to claim 1 wherein said substrate includes a substrate extension region which extends beyond said lid, and wherein said input/output pads are located in said substrate extension region.

9. A micro relay module according to claim 1 wherein at least one of said lid and said substrate further includes active microelectronic circuits.

10. A micro relay module according to claim 9 wherein said micromachined relay is integrally formed on one of said substrate and said lid, and wherein said active microelectronic circuits are integrally formed on the other of said substrate and said lid.

11. A microelectromechanical system (MEMS) module comprising:

a substrate and a lid in spaced apart relation;

a solder ring which bonds said lid to said substrate to define a chamber therebetween;

a MEMS device integrally formed on one of said substrate and said lid, within said chamber;

gas in said chamber, at a gas pressure which is above atmospheric pressure, and contacting said MEMS device; and a plurality of input/output pads outside said chamber, and electrically connected to said MEMS device.

12. A MEMS module according to claim 11 wherein said MEMS device is integrally formed on a face of said substrate within said chamber, and wherein said plurality of input/output pads are formed on said substrate face, outside said chamber.

13. A MEMS module according to claim 12 wherein said substrate further comprises means for electrically connecting said MEMS device to said input/output pads.

14. A MEMS module according to claim 11 wherein said MEMS device is integrally formed on a face of said lid within said chamber, and wherein said MEMS device further comprises means, within said chamber, for electrically connecting said MEMS device to said substrate.

15. A MEMS module according to claim 14 wherein said electrically connecting means comprises a plurality of solder bumps within said chamber, extending between said substrate and said lid.

16. A MEMS module according to claim 11 wherein each of said substrate and said lid include a solder wettable bonding site thereon, and wherein said solder ring bonds said solder wettable bonding sites to one another.

17. A MEMS module according to claim 11 wherein said chamber is free of solder flux therein.

18. A MEMS module according to claim 11 wherein said substrate includes a substrate extension region which extends beyond said lid, and wherein said input/output pads are located in said substrate extension region.

19. A MEMS module according to claim 11 wherein at least one of said lid and said substrate further includes active microelectronic circuits.

20. A MEMS module according to claim 19 wherein said MEMS device is integrally formed on one of said substrate and said lid, and wherein said active microelectronic circuits are integrally formed on the other of said substrate and said lid.

21. A micro relay module comprising:

a substrate and a lid in spaced apart relation;

means for bonding said lid to said substrate to define a chamber therebetween;

a micromachined relay integrally formed on one of said substrate and said lid, within said chamber;

gas in said chamber, at a gas pressure which is above atmospheric pressure, and contacting said micromachined relay; and a plurality of input/output pads outside said chamber, and electrically connected to said micromachined relay.

22. A micro relay module according to claim 21 wherein said micromachined relay is integrally formed on a face of said substrate within said chamber, and wherein said plurality of input/output pads are formed on said substrate face, outside said chamber.

23. A micro relay module according to claim 22 wherein said substrate further comprises means for electrically connecting said micromachined relay to said input/output pads.

24. A micro relay module according to claim 21 wherein said micromachined relay is integrally formed on a face of said lid within said chamber, and wherein said micro relay module further comprises means, within said chamber, for electrically connecting said micromachined relay to said substrate.

25. A micro relay module according to claim 24 wherein said electrically connecting means comprises a plurality of solder bumps within said chamber, extending between said substrate and said lid.

26. A micro relay module according to claim 21 wherein said chamber is free of solder flux therein.

27. A micro relay module according to claim 21 wherein said substrate includes a substrate extension region which extends beyond said lid, and wherein said input/output pads are located in said substrate extension region.

28. A micro relay module according to claim 21 wherein at least one of said lid and said substrate further includes active microelectronic circuits.

29. A micro relay module according to claim 28 wherein said micromachined relay is integrally formed on one of said substrate and said lid, and wherein said active microelectronic circuits are integrally formed on the other of said substrate and said lid.

30. A microelectromechanical system (MEMS) assembly comprising:

a substrate and a lid in spaced apart relation;

an array of solder rings between said lid and said substrate, which bond said lid to said substrate to define an array of chambers therebetween;

an array of MEMS devices integrally formed on one of said substrate and said lid, a respective at least one of which is enclosed in a respective one of said chambers;

gas in said chambers, at a gas pressure which is above atmospheric pressure, and contacting the MEMS device in the chamber; and an array of an input/output pads outside said chambers, a respective one of which is electrically connected a respective at least one of said MEMS devices.

31. A MEMS assembly according to claim 30 wherein said array of MEMS devices is integrally formed on a face of said substrate within said chambers, and wherein said array of input/output pads is formed on said substrate face, outside said chambers.

32. A MEMS assembly according to claim 31 wherein said substrate further comprises means for electrically connecting respective ones of said MEMS devices to respective ones of said input/output pads.

33. A MEMS assembly according to claim 30 wherein said array of MEMS devices is integrally formed on a face of said lid within said chambers, and wherein said MEMS assembly further comprises means, within said chambers, for electrically connecting respective ones of said MEMS devices to said substrate.

34. A MEMS assembly according to claim 33 wherein said electrically connecting means comprises at least one solder bump within each of said chambers, extending between said substrate and said lid.

35. A MEMS assembly according to claim 30 wherein each of said substrate and said lid include an array of solder wettable bonding sites thereon, and wherein said solder rings bond said solder wettable bonding sites to one another.

36. A MEMS assembly according to claim 30 wherein said chambers are free of solder flux therein.

37. A MEMS assembly according to claim 30 wherein at least one of said lid and said substrate further includes active microelectronic circuits.

38. A MEMS assembly according to claim 37 wherein said MEMS devices are integrally formed on one of said substrate and said lid, and wherein said active microelectronic circuits are integrally formed on the other of said substrate and said lid.

39. A method of fabricating a plurality of microelectromechanical system (MEMS) modules comprising the steps of:

integrally forming an array of MEMS devices on a face of a first substrate;

placing a second substrate adjacent said face with a corresponding array of solder rings therebetween, a respective solder ring surrounding a respective MEMS device;

reflowing said solder rings in a gas atmosphere which is above atmospheric pressure, to thereby form an array of high pressure gas encapsulating chambers for said array of MEMS devices; and singulating said first and second substrates to form a plurality of individual MEMS modules.

40. A method according to claim 39 wherein said integrally forming step comprises the step of integrally forming an array of MEMS devices and an array of input output/pads on said face.

41. A method according to claim 39 wherein said placing step comprises the steps of:

bonding said array of solder rings to said second substrate; and placing said second substrate adjacent said face, with the bonded array of solder rings therebetween.

42. A method according to claim 39 wherein said placing step comprises the steps of:

bonding said array of solder rings to said face; and placing said second substrate adjacent said face, with the bonded array of solder rings therebetween.

43. A method according to claim 39:

wherein said reflowing step is preceded by the step of performing a fluxless plasma treatment on said solder rings; and wherein said reflowing step comprises the step of reflowing said solder rings without using flux.

44. A method according to claim 39:

wherein said integrally forming step comprises the step of integrally forming an array of MEMS devices and an array of input output/pads on said face, with the array of input/output pads being located on said face in spaced apart relation to the corresponding array of MEMS devices, such that said input/output pads lie outside said array of solder rings; and wherein said singulating step comprises the steps of:

cutting said first substrate around each corresponding group of MEMS devices and input/output pads; and cutting said second substrate twice around each ring, to allow separation of individual second substrates and to expose said input/output pads.

* * * * *

UNITED STATES PATENT AND TRADEMARK OFFICE
CERTIFICATE OF CORRECTION

PATENT NO. : 6,025,767

DATED : February 15, 2000

INVENTOR(S) : Kellam et al.

It is certified that error appears in the above-identified patent and that said Letters Patent is hereby corrected as shown below:

Title page, [56] References Cited:

U.S. PATENT DOCUMENTS, line 1, "557,132 9/1896 Takashi" should read --5,557,132 9/1996 Takahashi--.

OTHER PUBLICATIONS, last two lines, ""PolArized" should read --Polarized--.

Column 6, last line, "12a" should read --129--.

Signed and Sealed this

Seventh Day of November, 2000

*Attest:*

Q. TODD DICKINSON

*Attesting Officer*

*Director of Patents and Trademarks*